US006432006B1

(12) United States Patent
Tribble

(10) Patent No.: US 6,432,006 B1
(45) Date of Patent: Aug. 13, 2002

(54) METAL/WOOD BAT

(76) Inventor: James G. Tribble, P.O. Box 267, Eleanor, WV (US) 25070

( * ) Notice: Subject to any disclaimer, the term of this patent is extended or adjusted under 35 U.S.C. 154(b) by 0 days.

(21) Appl. No.: 09/460,736

(22) Filed: Dec. 14, 1999

Related U.S. Application Data

(60) Provisional application No. 60/112,160, filed on Dec. 14, 1998.

(51) Int. Cl.[7] ..... A63B 59/06
(52) U.S. Cl. ..... 473/564; 473/566
(58) Field of Search ..... 473/564–568, 473/457, 519, 520

(56) References Cited

U.S. PATENT DOCUMENTS 1,509,733 A * 9/1924 Langford ..... 473/564
2,195,681 A * 4/1940 Robarge ..... 473/564
3,877,698 A 4/1975 Volpe ..... 273/72 R
4,682,773 A * 7/1987 Pomilia ..... 473/457
4,714,251 A 12/1987 Cook ..... 273/72 R
4,720,104 A 1/1988 DiSieno ..... 273/67 R
5,409,214 A * 4/1995 Cook ..... 473/564

* cited by examiner

*Primary Examiner*—Mark S. Graham
(74) *Attorney, Agent, or Firm*—Steptoe & Johnson PLLC

(57) ABSTRACT

A bat is disclosed having a metal handle portion, a wood barrel portion with a locking portion fitting within a barrel receiving end of the metal handle portion, and a means for securing the metal handle portion to the wood barrel portion. The means for securing the two portions of the bat is a locking pin system wherein the preferred embodiment is a locking pin having a first end and a second end and extending the length of the metal handle portion. The first end of the locking pin is secured to the locking portion of the wood barrel portion by inserting the locking pin into a locking pin bore drilled longitudinally in the locking portion of the wood barrel portion.

49 Claims, 8 Drawing Sheets

METAL/WOOD BAT

CROSS-REFERENCE TO RELATED APPLICATIONS

This application claims the benefit of U.S. application Ser. No. 60/112,160, filed Dec. 14, 1998.

BACKGROUND OF THE INVENTION

1. Field of Technology

The present invention relates to bats, and more particularly to bats combining a metal handle portion with a wood barrel portion.

2. Related Art

There are two dominate types of bats used in both softball and baseball-aluminum and wood. Although most school leagues allow players to use either type of bat, the Little League organization and the Major League only allow players to use wooden bats and this is for safety reasons. It is well known that players can hit a ball harder and longer with the lighter aluminum bats. Therefore, these two organizations recognize the principal safety factor associated with using wooden bats; that is, slower ball speed coming off of the bat.

However, wood bats also have a safety issue in that the handle portion of a wood bat tends to break above the players grip. This is an important concern because upon a wood bat breaking, the top barrel, or hitting, portion often becomes a projectile which may hit and injure another player or an innocent bystander. For example, testing has shown that a conventional Little League wood bat breaks, i.e., snaps at the handle, when the bat's swinging speed reaches about 72–75 mph. This breakage is due to the fact that the wood does not "give" to the torque on the bat during a high powered swing. In contrast, conventional aluminum bats do not break at the handle. The principal safety issue regarding aluminum bats is the ball speed coming off of the bat.

Therefore, there is a need for a bat that combines the wooden barrel portion of a conventional wood bat with the metal handle portion of a conventional aluminum bat in order to take advantage of both types of bats: the safety of a wood barrel with the strength of a metal handle. There is a further need for a metal/wood bat that does not break during normal usage. There is still a further need for a metal/wood bat that ensures that the two portions of the bat do not separate during use or upon the infrequent breaking of the bat.

It also is well appreciated that baseball players have a difficult time making the transition from using an aluminum bat to a wood bat. The aluminum bats have a larger "sweet" spot on the barrel, thereby making it easier for a player to get a good hit. In contrast, wood bats have a smaller "sweet" spot on the barrel, thereby requiring a player to have better eye-hand coordination to get a good hit. Therefore, despite a player's success and good batting statistics using aluminum bats, the player may not have the same level of success upon changing over to wood bats.

In U.S. Pat. No. 5,409,214 to Cook, a bat is disclosed having a handle part formed of metal and a hitting part formed of one, two or more pieces of wood connected by finger joints. Specifically, the bat comprises a hitting member that may be a single piece of wood. The hitting member is defined as having a barrel end and a handle end wherein the handle end terminates about 1–2 inches from the knob. Therefore, in essence, the wood portion of the Cook bat is about as long as a conventional wood bat. The bat is constructed by using an adhesive to secure the metal portion over the handle end of the wood portion (hitting member). In fact, the metal handle of Cook does not replace the wood handle of a conventional wood bat, but rather, the Cook handle merely reinforces the wood handle of the wood hitting member.

Although the Cook bat appears to disclose a metal/wood bat, there are many disadvantages with the Cook bat that make it impractical to use. First, the metal handle part simply covers, or reinforces, the handle end of the wood hitting member. No matter how close the wood handle is fit within the metal handle, a vibration will occur when a player hits a ball, thereby interfering with the player's grip on the bat. Secondly, the vibration upon hitting a ball fit will have a damaging effect on the adhesive connection between the wood handle part and the metal handle part. The metal and wood parts of the bat are only secured together by an adhesive and once the adhesive breaks down, the two parts will separate. Therefore, the vibration resulting from hitting a ball will break down that adhesive connection. Then, upon hitting one more ball, the two pieces will separate resulting in the wooden hitting member becoming a projectile, as with a conventional wood bat, and possibly hurting someone.

Therefore, there is a need for a metal/wood bat wherein only the barrel portion of the bat is made of wood and the handle portion of the bat is only made of metal such that all vibrational shock resulting from hitting a ball is eliminated. There is a further need for a metal/wood bat wherein the wood barrel portion cannot separate from the metal handle portion, thereby eliminating all possibility of the wood barrel portion becoming a dangerous projectile.

Another disadvantage of an aluminum bat is the knob. On a conventional aluminum bat, the knob is typically only welded on to the handle end of a bat. Therefore, during extended or hard use, the knob may break off of a bat, causing the player to lose his/her grip on the bat and the bat to "fly" from the player and potentially injure someone.

Therefore, there is a need for a metal/wood bat wherein the knob is incorporated into the metal handle of the bat eliminating all potential for the knob to break off and cause an injury.

SUMMARY OF THE INVENTION

The bat of the present invention solves the problems associated with conventional bats by combining a wood barrel portion and a metal handle portion, wherein the hitting portion of the wood barrel portion comprises no more than about 40% of the total length of the bat and the metal handle portion with a knob comprises no more than about 60% of the total length of the bat. The wood barrel portion and the metal handle portion are secured together in such a manner as to prevent the separation of the two portions at any time.

In the preferred embodiment, a locking pin system is used as the means for securing the wood barrel portion to the metal handle portion of the bat. The preferred locking pin system is a locking pin having a first end rigidly fixed to the wood barrel portion and a second end rigidly fixed to a knob secured to the handle end of the metal handle portion, wherein the locking pin has a length equal to about the length of the metal handle portion.

The first end of the locking pin is inserted and secured into a locking pin bore drilled longitudinally though a locking portion of the wood barrel portion. In addition, a T-pin is used as another means for securing the first end of the locking pin to the wood barrel end, wherein the T-pin passes traversely through the wood barrel portion and the locking pin. The second end of the locking pin passes through a central bore in the knob and is secured with a locking nut. Both the first end and the second end of the locking pin are further secured by a liquid adhesive or filler.

In an alternative embodiment, the locking pin system comprises a screw that, at a minimum, extends about the length of the metal handle portion and connects the knob of the metal handle portion to the wood barrel portion. In another embodiment, the screw extends the entire length of the bat.

There are many advantages associated with the metal/wood bat of the present invention. First, the locking pin system of the present invention, used to secure the two portions of the bat, provides a means whereby the inherent mechanics of the locking pin naturally pulls the two opposite ends of the bat together during a player's swing. This is in direct contrast to the natural tendency of the two opposite ends to repel each other during a player's swing. Therefore, the locking pin system affirmatively holds the bat together during use.

Second, upon contacting a ball, conventional wooden bats often break at the handle portion at a point directly above the batter's hands and below the bat stamp, thereby resulting in injury to the batter or a by-stander. The metal/wood bat of the present invention eliminates such breakage due to the metal handle portion. Therefore, the present invention allows a batter to use a wood barrel portion without the fear of the bat breaking upon contact with a ball. For example, initial testing shows that the metal/wood bat of the present invention can withstand swinging speeds in excess of 105 mph without the bat breaking. In addition, if the metal/wood bat of the present invention were to break, the bat would not create flying projectiles. The locking pin embedded within the bat to secure the wood barrel portion and the metal handle portion holds the pieces together upon breakage.

Third, wood bats are used by all United States Major League baseball teams, whereas other teams (e.g., little league, softball, and schools) can typically use either metal or wood bats. Most of these other teams use metal bats because wood bats are very costly to replace when they break, which is often. The present invention provides a metal/wood bat wherein the teams can use wood bats, benefiting from the advantages of using a wood barrel portion, without incurring the additional costs associated with replacing broken wood bats.

Fourth, the metal/wood bat of the present invention provides the means by which more players can "hit" with a wood bat, or at least a wood barrel portion, thereby gain the much needed experience of using a wood bat. This will eliminate the troublesome transition associated with a player switching between using an aluminum bat to using a wood bat.

Fifth, the metal/wood bat of the present invention maintains the standard length, weight, and weight distribution of conventional wood bats. Therefore, by using a metal/wood bat, once again a player does not have a difficult transition from playing baseball in school, such as in college, to the Major League.

Sixth, the wood barrel portion of the present invention may be either permanently secured to the handle portion, or may be removably secured thereon. If permanently secured, the metal/wood bat becomes functionally equivalent to a bat made entirely of wood but without the need of continual replacement. If removably secured, a batter may interchange different wood barrels with a favorite handle portion. This feature allows a batter to select a longer, or different weight bat, depending on the batting conditions, while at the same time, allowing the batter to use a specific handle portion with a specific or comfortable grip.

DESCRIPTION OF THE FIGURES

The present invention is described with reference to the accompanying drawings. In the drawings, like reference numbers indicate identical or functionally similar elements. Additionally, the left-most digit(s) of a reference number identifies the drawings in which the reference number first appears.

DETAILED DESCRIPTION OF THE PREFERRED EMBODIMENTS

Figure 1:
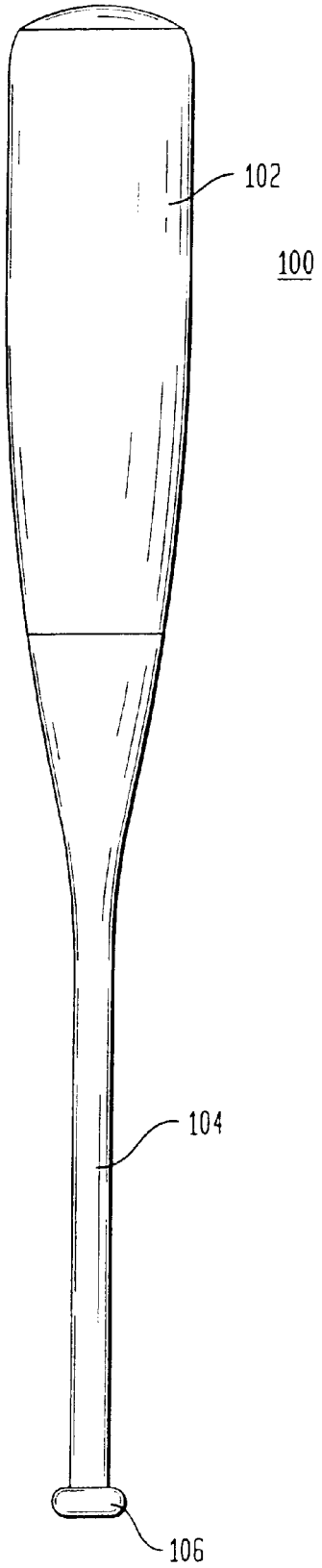
FIG. 1: A planar side view of the bat of the present invention.
Figure 2:
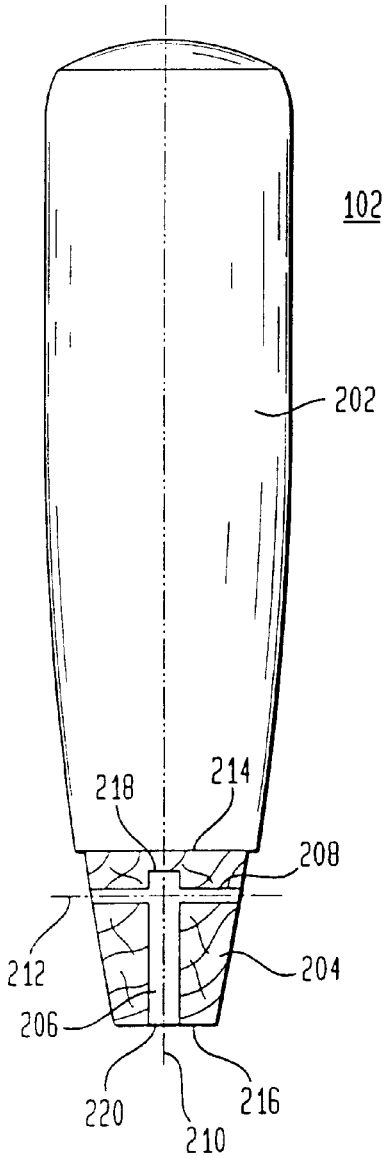
FIG. 2: A planar cross sectional side view of the wood barrel portion of the bat.
Figure 3:
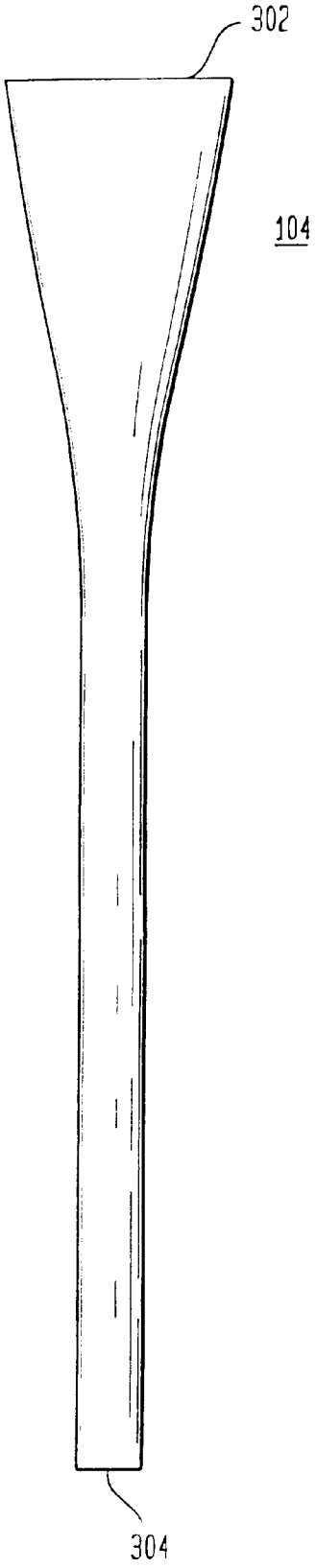
FIG. 3: A planar cross sectional side view of the metal handle portion of the bat.
Figure 4:
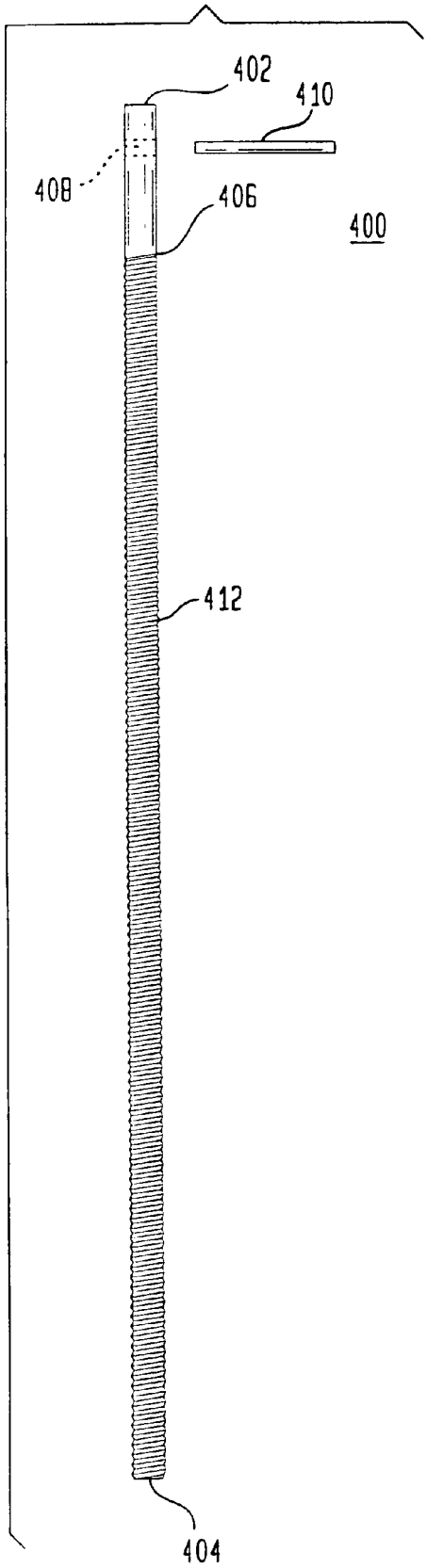
FIG. 4: A planar side view of the pin connectors.
Figure 5A:
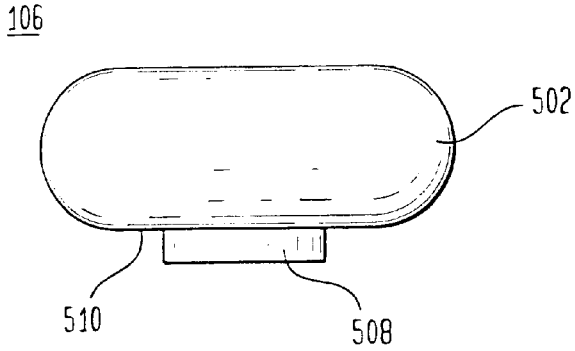
FIG. 5A: A planar side view of a knob.
Figure 5B:
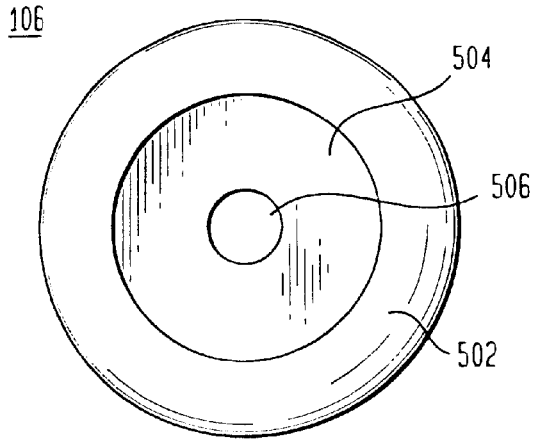
FIG. 5B: A planar top view of the knob.
Figure 5C:
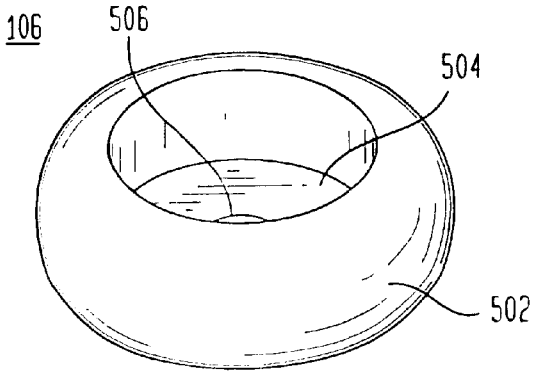
FIG. 5C: A perspective top view of the knob.
Figure 6:
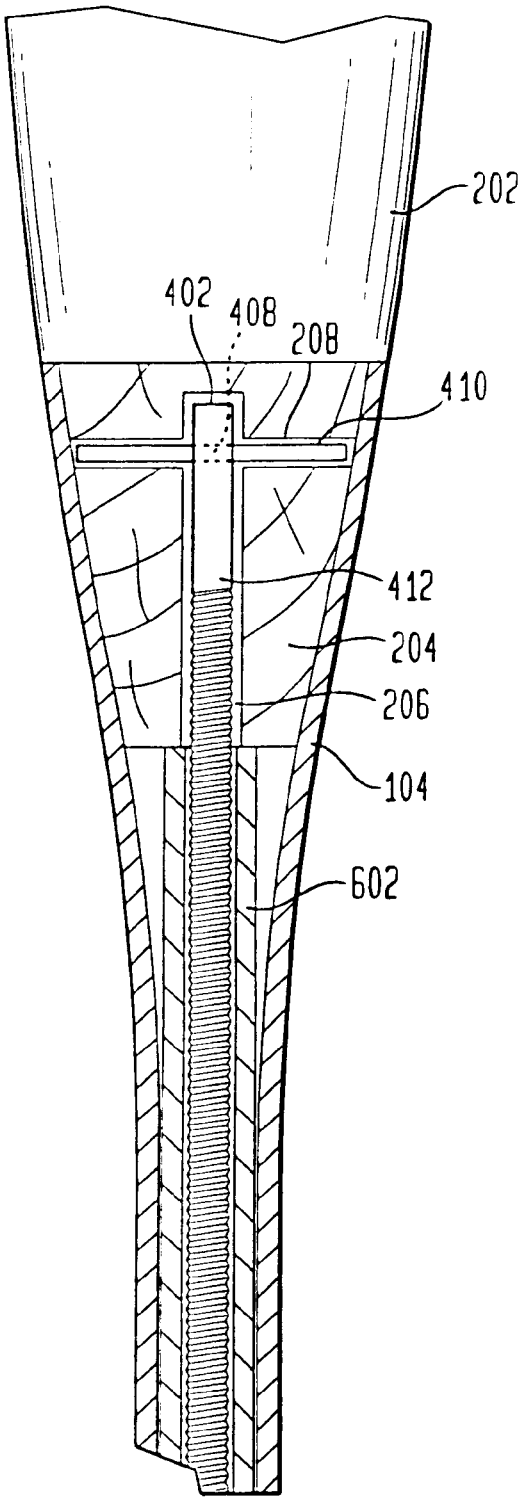
FIG. 6: A planar cross sectional side view of the connection between the wood barrel portion and the metal handle portion.
Figure 7:
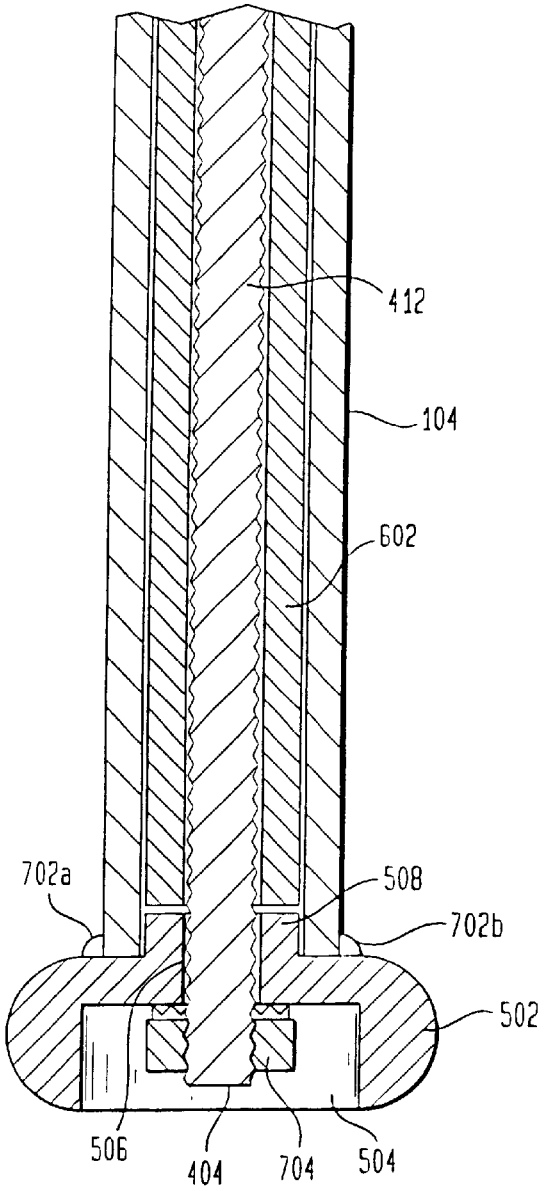
FIG. 7: A planar cross sectional side view of the connection between the metal handle portion and the knob.

FIGS. 1–5 show the different component parts of the metal/wood bat (or "bat") 100 of the present invention, wherein FIGS. 6 and 7 illustrate how the component parts are secured together to manufacture a stable bat construction. The bat 100 comprises a wood barrel portion 102 and a metal handle portion 104 having a knob 106 at its distal end. The wood barrel portion 102 is designed and manufactured according to conventional wood bat methods. In the preferred embodiment, the metal handle portion 104 is a hollow piece of metal, e.g., aluminum, manufactured using well known forging techniques. Forging is the preferred method of manufacture because it ensures a uniform thickness and quality along the walls of the entire length of the metal handle portion 104. The wood barrel portion 102 and the metal handle portion 104 are such that the total size, weight, and weight distribution of the bat 100 of the present invention are identical to those of conventional bats. Once the bat 100 is manufactured, a batter may place any conventional type of grip on the metal handle portion 104 for comfort and improvement of his/her batting.

In the preferred embodiment, the wood barrel portion 102 of the bat 100 has a hitting portion 202 and a locking portion 204. The hitting portion 202 is the exposed area of the bat 100 for hitting a ball, and the locking portion 204 is that part of the wood barrel portion 102 for interlocking with the metal handle portion 104. In the preferred embodiment, the locking portion 204 tapers from a first diameter of about 1⅝(1.625) inches to a second diameter of about 0.985 inches and is about 3 inches in length. The tapering diameter of the locking portion 204 is recessed about ⅛ of an inch smaller than the diameter of the hitting portion 202 to ensure its fit within the metal handle portion 204. The taper of the locking portion 204 is about equal to the angle of taper of the barrel receiving end 302 of the metal handle portion 104.

Also in the preferred embodiment, there are two bores in the wood barrel portion 102 of the bat 100. First, a locking pin bore 206, having a top end 218 and a bottom end 220, is drilled longitudinally through the center of the locking portion 204; that is, through vertical plane 210. The locking pin bore 206 is about 2⅞ inches in length and about 11/32 inches in diameter. Second, a T-pin bore 208 is drilled traverse to the locking pin bore 206, in proximity to the top end 218 of the locking pin bore 206 (preferably about ¼ of an inch from the top end 218) and through the center of the locking portion 204; that is, through horizontal plane 212. The T-pin bore 208 has a length equal to the diameter of the locking portion 204 and has a diameter of about 0.100 inches.

The metal handle portion 102 is an elongated hollow tube that tapers from a barrel receiving end 302 to a handle end 304. In the preferred embodiment, the metal handle portion 104 is about 0.085 inches thick hollow poured aluminum metal, however any comparable metal and size may be used. The barrel receiving end 302 of the handle portion 104 is tapered at the same angle as the locking portion 204 of the wood barrel portion 102. Therefore, when the locking portion 204 is fit within the barrel receiving end 302, there is a close fit between the barrel receiving end 302 and the locking portion 204 along the entire length of the locking portion 204.

The means for securing 400 the wood barrel portion 102 to the metal handle portion 104 of the bat 100 is a locking pin system, wherein the preferred locking pin system comprises two pin connectors. First, a locking pin 412, having a first end 402 and a second end 404, is used to secure the wood barrel portion 102 through the length of the metal handle portion 104 to the knob 106. The locking pin 412 is a ¼ inch diameter, solid, threaded rod about the same length as the metal handle portion 104. The entire locking pin 412 does not have to be threaded. In fact, in the preferred embodiment, the second end 404 is threaded whereas about an inch of the first end 402 is not threaded. The locking pin 412 also comprises an anchor bore 408, about 0.100 inches in diameter, drilled traverse to its longitudinal plane through center near its first end 402, about ¼ of an inch from the first end 402. The anchor bore 408 and its function are described in greater detail below.

The locking pin 412 is made of either aluminum or titanium, depending on the strength needed to secure the bat 100. For example, a bat 100 intended for Little League players may incorporate an aluminum locking pin 412, wherein a bat 100 intended for Major League players may incorporate a titanium locking pin 412. The locking pin 412 is secured in the locking pin bore 206 of the wood barrel portion 102 by a liquid adhesive filler that solidifies over time, such as commercially available Devcon 2 Ton Liquid Steel Fill, thereby providing the first means for securing the locking pin 412 to the wood barrel portion 102. Furthermore, when the locking pin 412 is inserted in the locking pin bore 206, there is preferably a gap, about ⅛ of an inch, between the first end 402 of the locking pin 412 and the end of the locking pin bore 206. Therefore, when the locking pin bore 206 is filled with the liquid filler, e.g., an adhesive, the filler cushions the locking pin 412 and ensure that there is no metal-to-wood contact.

In the preferred embodiment, the lengths of the metal handle portion 104, the hitting portion 202 (which is the length of the wood barrel portion 102 minus the length of the locking portion 204), and the locking pin 412 vary according to the final bat 100 length. The preferred lengths are shown in Table 1.

TABLE 1

| Preferred Lengths | | | |
|---|---|---|---|
| Final Bat Length | Metal Handle Portion (including knob) | Locking Pin Length | Hitting Portion Length |
| 34" | 22" | 21⅞" | 12" |
| 33" | 21½" | 21⅜" | 11½" |
| 32" | 20¾" | 20⅝" | 11¼" |
| 31" | 20" | 19⅞" | 11" |
| 30" | 19½" | 19⅜" | 10½" |
| 29" | 19" | 18⅞" | 10" |
| 28" | 18½" | 18⅜" | 9½" |
| 27" | 18" | 17⅞" | 9" |
| 26" | 17½" | 17⅜" | 8½" |
| 25" | 17" | 16⅞" | 8 |

Therefore, in the preferred embodiment, the hitting portion 202 of a bat 100 of the present invention is no more than 40% of the total length of the bat 100, and the metal handle portion 104 with the knob 106 of a bat 100 of the present invention is no more than 60% of the total length of the bat 100. More specifically, the optimum ratios are that a bat 100 of the present invention is comprised of 32–36% wood (hitting portion 202) and 68–64% metal (metal handle portion 104 with knob 106).

The second pin connector in the locking pin system is a T-pin 410 which in the preferred embodiment is a 0.93 inch carbon steel pin about 1½ inches in length. The T-pin 410 also is used to anchor the first end 402 of the locking pin 412 to the locking portion 204 of the wood barrel portion 102 of the bat 100. When the locking pin 412 is inserted into the locking pin bore 206 of the locking portion 204 of the wood barrel portion 102, the T-pin bore 208 of the locking portion 204 aligns with the anchor bore 408 of the locking pin 412. The T-pin 410 is then inserted through the T-pin bore 208 and the anchor bore 408, thereby providing a second means for securing the locking pin 412 to the wood barrel portion 104.

The locking pin 412 extends about the length of the metal handle portion 104 wherein the second end 404 extends beyond the handle end 304 of the metal handle portion 104 and secures to a knob 106. In the preferred embodiment, the knob 106 is about 1⅝ inches in diameter, about ¾ inches in thickness, and comprises a rim 502, a recessed portion 504 and a central bore 506 through which the second end 404 of the locking pin 412 passes. Also in the preferred embodiment, a circular flange 508 extends from the bottom side 510 of the knob 106 and is inserted into the handle end 304 of the metal handle portion 104. The diameter of the flange 508 is about equal to the inside diameter of the handle end 304 of the metal handle portion 104. The knob 106 of the present invention may be used with any bat 100 employing a locking pin 412 or similar locking pin system for securing the bat 100.

FIG. 6 shows the preferred embodiment for securing the locking pin 412 to the wood barrel portion 102 of the bat 100. As seen, the first end 402 of the locking pin 412 is inserted into the locking pin bore 206 of the locking portion 204 of the wood barrel portion of the bat 100 such that the T-pin bore 208 aligns with the anchor bore 408 of the locking pin 412. Once the locking pin 412 is properly aligned, the T-pin 410 is inserted through the T-pin bore 208 and the anchor bore 408 until the ends of the T-pin 410 are flush with the edges of the locking portion 204. After securing the two pins, a liquid alloy, epoxy, or adhesive filler that solidifies over time is injected into the locking pin bore 206. In the preferred embodiment, the commercially available Devcon 2 Ton Liquid Steel Fill is used. Once the filler is dry, the remainder of the bat 100 can be assembled.

Also shown in FIG. 6 is an alternative embodiment of the bat 100 in which an insulation tube 602 is used to cushion the locking pin 412. The insulation tube 602 is a ⅝ inch diameter tubular form of foam rubber having a central bore drilled out about ¼ inches in diameter. The insulation tube 602 slides over the locking pin 412 and fills up most if not all of the hollow metal handle portion 104 between the locking portion 204 of the wood barrel portion 102 and the handle end 304 of the metal handle portion 104. The insulation tube 602 acts as a shock absorber and assists in keeping the locking pin 412 in proper alignment within the metal handle portion 104. Once the locking pin 412 is properly installed, the remainder of the bat 100 is assembled.

In the preferred embodiment, the knob 106 is pre-welded 702*a,b* to the appropriate length of metal handle portion 104. Next, liquid epoxy or other adhesive is spread in the interior of the barrel receiving portion 302 of the metal handle portion 104. The locking portion 204 of the wood barrel portion 102 is then inserted into the barrel receiving end 302 of the metal handle portion 104 with the second end 404 of the locking pin 412 extending through the metal handle portion 104 and through the central bore 506 of the knob 106. The two portions are twisted together until the locking portion 204 is fully within the barrel receiving end 302. In addition to the locking pin system, the use of a liquid adhesive is another means for securing the wood barrel portion 102 to the metal handle portion 104.

Once the two portions are secured together, a locking nut 704 is threaded onto the second end 404 of the locking pin 412 to secure the locking pin 412 to the knob 106. In the preferred embodiment, the locking nut 704 is tightened to about four pounds of torque and Loc-Tite is used to enhance the hold of the locking nut 704 to the threads of the locking pin 412. Loc-Tite is a commercially available product for securing nuts to threaded bolts. After the locking nut 704 is secure, the recessed portion 504 of the knob 106 is filled with a liquid rubber filler, e.g., liquid Flaxane 80, to ensure that no person can tamper with the bat 100 and its construction.

The second end 404 of the locking pin 412 is secured to the knob 106 for convenience purpose only. It would be readily apparent for one of ordinary skill in the relevant art to secure the second end 404 of the locking pin 412 to the handle end 304 of the metal handle portion 104. and not to the knob 106 For example, a second T-pin may be used at the handle end 304 which is traverse to the longitudinal plane of the metal handle portion 104 and passes through the second end 404 of the locking pin 412 and the walls of the handle end 304.

Figure 8:
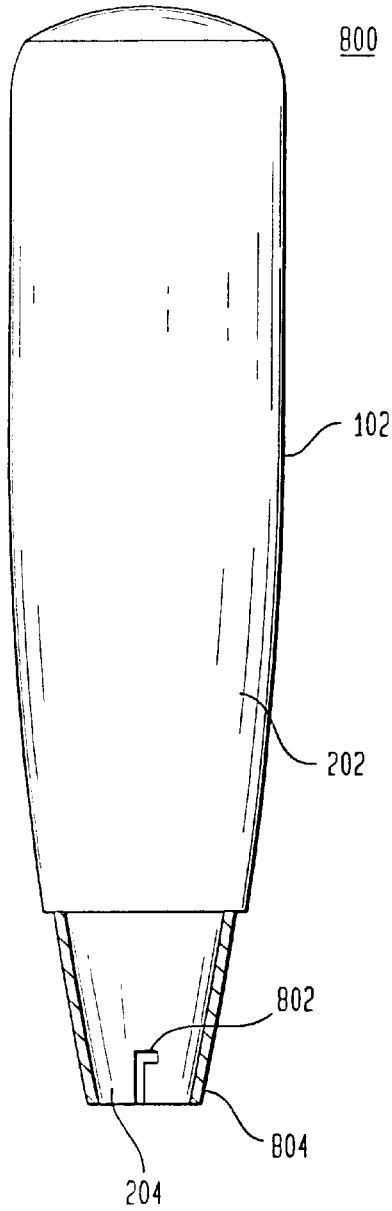
FIG. 8: A planar cross sectional side view of an alternative wood barrel portion.
Figure 9:
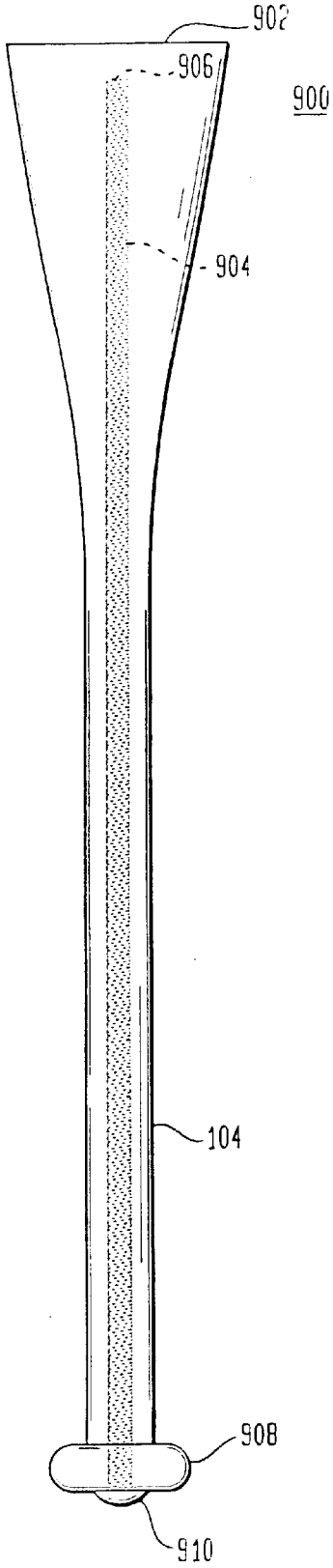
FIG. 9: A planar cross sectional side view of an alternative metal handle portion.

FIG. 8 shows a planar cross sectional side view of an alternative embodiment of the hitting portion 808 and the locking portion 810 of a wood barrel portion 806 of a bat, wherein FIG. 9 shows an alternative locking pin system. In this embodiment, a cushioning sleeve 804 is wrapped around the locking portion 810 of the wood barrel portion 806. The cushioning sleeve 804 is a piece of rubber that is about 0.045 inches thick and completely covers the entire locking portion 810. The purpose of the cushioning sleeve 804 is to absorb the shock traveling down the locking portion 810 when a player hits a ball on the seam between the wood barrel portion 806 and the metal handle portion 912. In order for a locking portion 810 with a cushioning sleeve 804 to fit within the barrel receiving end 902 of a metal handle portion 912, the locking portion 810 diameter must be reduced by the thickness of the cushioning sleeve 804. A cushioning sleeve 804 may be used with any embodiment of a locking portion of a wood barrel portion of the present invention.

A second feature of this alternative embodiment is the means for securing the wood barrel portion 806 to the metal handle portion 912. In this embodiment, a screw 904 extends the entire length of the metal handle portion 912 having a head end 910 at the knob 908 of the bat and having an engaging end 906 for securing to the wood barrel portion 806. The screw 904 is preferably a 3/16 inch, or up to ¼ inch, titanium steel pin with a slotted head 910. The screw 904 may be threaded its entire length, but this is not necessary. Only a short length at the engaging end 906 of the screw 904 needs to be threaded so as to fully engage a receiving hole 802 in the locking portion 204 of the wood barrel portion 806. It would be readily apparent to one of ordinary skill in the relevant art to use a comparable screw 904 or means for engaging the wood barrel portion 806 with the metal handle portion 912.

In operation, the locking portion 810 of the wood barrel portion 806 is pressure fit within the barrel receiving end 902 of the metal handle portion 912, wherein the engaging end 906 of the screw 904 fits within the receiving hole 802. Then, the screw 904 may be tightened via the head end 910 such that the engaging end 906 of the screw 904 is firmly secured within the receiving hole 802 of the wood barrel portion 806. If the wood barrel portion 806 is to remain removable from the metal handle portion 912, no other means for securing the two portions is required. Therefore, when a batter wants a different wood barrel portion 806 on a specific metal handle portion 912, he/she simply unscrews the wood barrel portion 806 and replaces it with a new wood barrel portion.

If the wood barrel portion 806 is to remain fixed on a metal handle portion 912, then prior to fitting the two portions together, a liquid adhesive or metal filler that solidifies over time (e.g., liquid steel or aluminum) may be first inserted into the receiving hole 802. Therefore, when the engaging end 906 of the screw 904 is fit within the receiving hole 802 and the screw 904 is tightened, a permanent bond is created such that the wood barrel portion 806 is not removable from the metal handle portion 912.

In this embodiment, the receiving hole 802 is about one inch in length. The receiving hole 802 must be of such a length so as to not be too close to the end of the wood barrel portion 102. If the receiving hole 802 is too short, it would not provide a secure means of connecting the two portions. Also, the receiving hole 802 is "L" shaped so as to act as a shock absorber when securing the two portions together. That is, the screw 904 cannot be pulled out from the receiving hole 802 because the solidified liquid metal in the "L" chamber of the receiving hole 802 acts as an anchor. The use of an "L" shaped receiving hole 802 is for convenience purpose only. It would be readily apparent to one of ordinary skill in the relevant art to use a different shaped hole, such as the round chamber, and achieve the same means for securing.

Optionally, an adhesive may also be added between the locking portion 810 and the barrel receiving end 902 of the metal handle portion 912 so as to provide another means for securely connecting the two portions. The use of an adhesive, or comparable resin, would also prevent any spinning, or twisting, of the wood barrel portion 806 when hitting a ball.

Figure 10A:
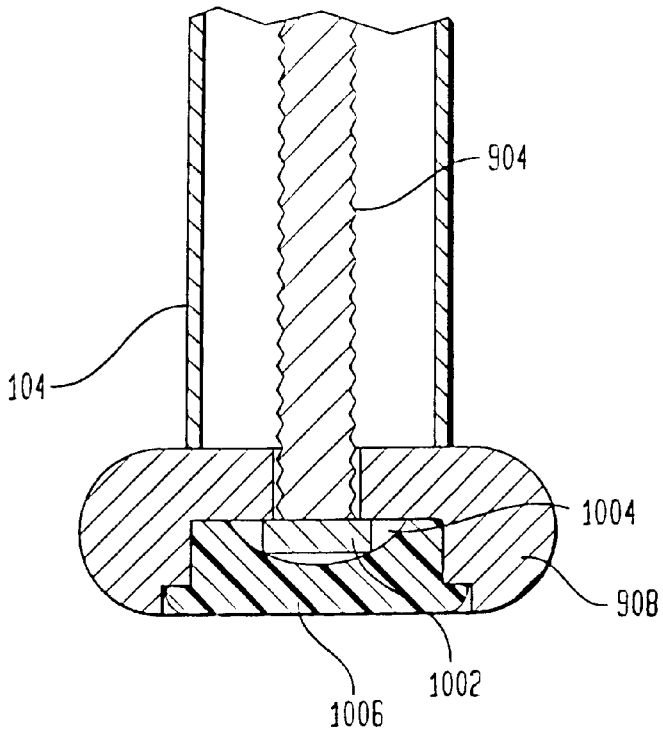
FIG. 10A: A planar cross sectional side view of an alternative knob.
Figure 10B:
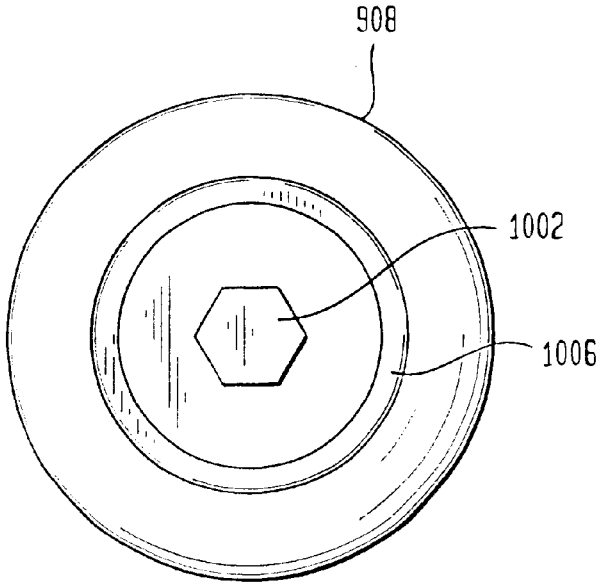
FIG. 10B: A planar top view of the alternative knob.

FIG. 10A is a planar side view of an alternative embodiment of the knob 908 of the metal handle portion 912 of the bat 100. FIG. 10B is a planar bottom view of the alternative knob 908. In this alternative embodiment, the screw 904 is rigidly fixed to the wood barrel portion 806 as described above. That is, the screw 904 is threaded in the receiving hole 802 and optionally secured with a liquid adhesive or metal filler. The head end 910 of the screw 904 terminates at the handle end of the metal handle portion 912 and is secured with a lock nut 1002 embedded within the knob 908 of the bat. The screw 904 extends through the metal handle portion 912 and through a central hole in the knob 908 where it is secured with the lock nut 1002. The central hole in the knob 908 passes through the entire knob 908 and may be smooth bore or may be threaded. In the preferred embodiment, the central hole though the knob 908 is threaded to add another means for securely connecting the two portions of the present invention wherein the threaded screw 904 engages the threads of the central hole in the knob 908. When the lock nut 1002 is fully engaged and closed, the wood barrel portion 806 and the metal handle portion 912 are securely interlocked, resulting in a complete and useable bat, wherein the knob 908 cannot break off.

When the lock nut 1002 is loosened and even removed, the wood barrel portion 806 and the metal handle portion 912 can be separated. In this embodiment, access to the lock nut 1002 is controlled via a covering cap 1006. The covering cap 1006 may be permanently sealed closed so that no person and access the lock nut 1002 and screw 904, thereby resulting in a bat that cannot be separated into its two portions. In addition, the lock nut 1002 may be welded in place 1004, providing another means for the two portions of the bat to be permanently secured together. Alternatively, the covering cap 1006 may be removable so that a person has access to the lock nut 1002. Once access is achieved, a person can loosen and remove the lock nut 1002, thereby separating the two portions of the bat. In the preferred embodiment, the covering cap 1006 is made of plastic and is pressure fit within the end of the knob 908, but this is for convenience purpose only. It would be readily apparent to one of ordinary skill in the art to build the present invention using a lock nut 1002, or a comparable one, and have it be either permanently sealed or removable.

Figure 11:
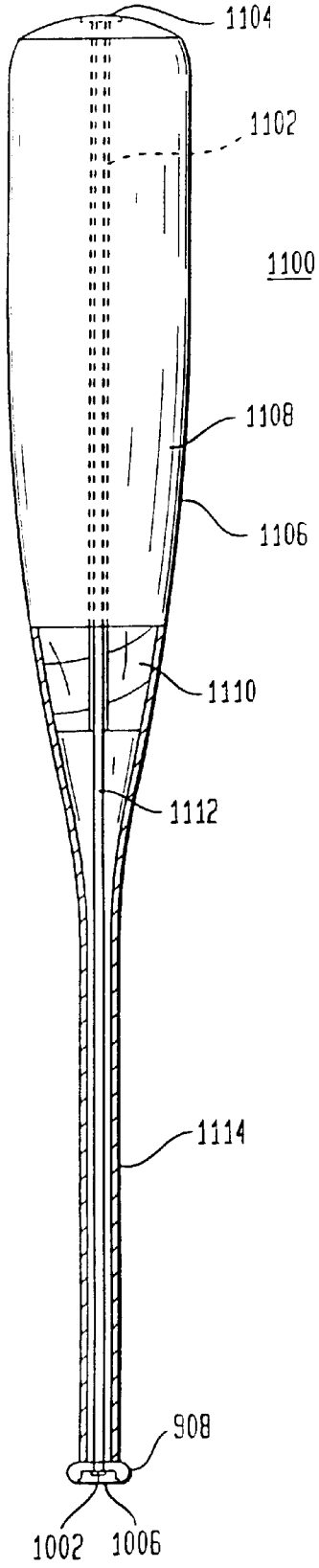
FIG. 11: A planar cross sectional side view of an alternative bat.

FIG. 11 is a planar cross sectional view of an alternative embodiment of the present invention wherein the bat 1100 comprises a wood barrel portion 1106 (having a hitting portion 1108 and a locking portion 1110) and a metal handle portion 1114 secured together with a screw 1112 traversing the entire length of the bat 1100. The receiving hole 1102 is drilled through the entire length of the wood barrel portion 1106 and has a rounded cap end 1104 that sits flush with the top of the bat 1100. Optionally, this embodiment may use liquid adhesive or metal filler that solidifies over time to further secure the screw 1112 within the receiving hole 1102. Such a filler would aid in the reduction of vibration of the screw 1112 within the receiving hole 1102.

All referenced dimensions in the preferred and alternative embodiments are for convenience purpose only. It would be readily apparent to one of ordinary skill in the relevant arts to design and build a bat of the present invention using different dimensions, e.g., for a junior size bat, a softball bat, or a standard adult size bat, and to use comparable materials and means for securing the bat together.

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

What is claimed is:

1. A bat, comprising:

a wood barrel portion having a hitting portion and a locking portion;

a metal handle portion being an elongated hollow tube having a length that tapers from a barrel receiving end to a handle end wherein said barrel receiving end is greater in diameter than said handle end and said barrel receiving end is the approximate taper as said locking portion of said wood barrel portion;

a knob attached to said handle end of said metal handle portion;

a means for securing said wood barrel portion to said metal handle portion, wherein said means comprises a locking pin having a first end, a second end, and a length, a means for securing said first end of said locking pin to said locking portion of said wood barrel portion, and a means for securing said second end of said locking pin to said knob, wherein said length of said locking pin extends about the length of said metal handle portion.

2. The bat according to claim 1, where said means for securing said first end of said locking pin to said locking portion of said wood barrel portion comprises a locking pin bore longitudinally centered in said locking portion of said wood barrel portion, and a means for securing said first end of said locking pin in said locking pin bore.

3. The bat according to claim 2, wherein said means for securing said first end of said locking pin in said locking pin bore comprises said first end of said locking pin being threaded and screwed into said locking pin bore.

4. The bat according to claim 2, wherein said means for securing said first end of said locking pin in said locking pin bore comprises a liquid filler injected into said locking pin bore.

5. The bat according to claim 2, wherein said means for securing said first end of said locking pin in said locking pin bore further comprises a T-pin bore in said locking portion of said wood barrel portion traverse to said locking pin bore, an anchor bore in said locking pin wherein said T-pin bore aligns with said anchor bore when said first end of said locking pin is inserted in said locking pin bore, and a T-pin having a length about the diameter of said locking portion of said wood barrel portion and inserted through said T-pin bore and said anchor bore.

6. The bat according to claim 5, wherein said means for securing said first end of said locking pin in said locking pin bore further comprises a liquid filler injected into said locking pin bore.

7. The bat according to claim 1, wherein said locking pin is aluminum.

8. The bat according to claim 1, wherein said locking pin is titanium.

9. The bat according to claim 1, wherein said knob comprises a rim, a central bore, and a recessed portion.

10. The bat according to claim 9 said knob further comprising a circular flange on a bottom end of said knob, having a diameter about equal to the inner diameter of said handle end of said metal handle portion.

11. The bat according to claim 9, wherein said means for securing said second end of said locking pin to said knob comprises said second end of said locking pin being threaded and a locking nut securing said second end of said locking pin in said recessed portion of said knob, wherein said second end of said locking pin passes through said central bore of said knob.

12. The bat according to claim 11, wherein said recessed portion of said knob is filled with a plastic filler.

13. The bat according to claim 1, further comprising a means for insulating said locking pin within said metal handle portion.

14. The bat according to claim 13, wherein said means for insulating is a tubular form of insulation having a central bore through which said locking pin extends.

15. The bat according to claim 14, wherein said tubular form of insulation is made of foam rubber.

16. The bat according to claim 1, further comprising a means for cushioning said locking portion of said wood barrel portion.

17. The bat according to claim 16, wherein said means for cushioning is a cushioning sleeve covering said locking portion.

18. The bat according to claim 17, wherein said cushioning sleeve is made of rubber.

19. The bat according to claim 1, wherein said hitting portion is no greater than about 40% of the length of the bat, and said metal handle portion with said knob is no greater than about 60% of the length of the bat.

20. The bat according to claim 1, wherein said hitting portion is within the range of about 32–36% of the length of the bat, and said metal handle portion with said knob is within the range of about 64–68% of the length of the bat.

21. The bat according to claim 1 wherein said means for securing said wood barrel portion to said metal handle portion further comprises an adhesive to further secure said locking portion of said wood barrel portion to said barrel receiving end of said metal handle portion.

22. A bat, comprising:

a wood barrel portion having a hitting portion and a locking portion;

a metal handle portion being an elongated hollow tube having a length that tapers from a barrel receiving end to a handle end wherein said barrel receiving end is greater in diameter than said handle end and said barrel receiving end is the approximate taper as said locking portion of said wood barrel portion;

a locking pin system for securing said wood barrel portion to said metal handle portion, wherein said locking pin system comprises a locking pin having a first end, a second end, and a length, a means for securing said first end of said locking pin to said locking portion of said wood barrel portion, and a means for securing said second end of said locking pin to said handle end of said metal handle portion, wherein said length of said locking pin extends about the length of said metal handle portion.

23. The bat according to claim 22 further comprising a knob attached to said handle end of said metal handle portion.

24. The bat according to claim 22, where said means for securing said first end of said locking pin to said locking portion of said wood barrel portion comprises a locking pin bore longitudinally centered in said locking portion of said wood barrel portion, and a means for securing said first end of said locking pin in said locking pin bore.

25. The bat according to claim 24, wherein said means for securing said first end of said locking pin in said locking pin bore comprises a liquid filler injected into said locking pin bore.

26. The bat according to claim 24, wherein said means for securing said first end of said locking pin in said locking pin bore further comprises a T-pin bore in said locking portion of said wood barrel portion traverse to said locking pin bore, an anchor bore in said locking pin wherein said T-pin bore aligns with said anchor bore when said first end of said locking pin is inserted in said locking pin bore, and a T-pin having a length about the diameter of said locking portion of said wood barrel portion and inserted through said T-pin bore and said anchor bore.

27. The bat according to claim 26, wherein said means for securing said first end of said locking pin in said locking pin bore further comprises a liquid filler injected into said locking pin bore.

28. The bat according to claim 22, wherein said locking pin is aluminum.

29. The bat according to claim 27, wherein said locking pin is titanium.

30. The bat according to claim 27, wherein said knob comprises a rim, a central bore, and a recessed portion.

31. The bat according to claim 22, further comprising a means for insulating said locking pin within said metal handle portion.

32. The bat according to claim 31, wherein said means for insulating is a tubular form of insulation having a central bore through which said locking pin extends.

33. The bat according to claim 32, wherein said tubular form of insulation is made of foam rubber.

34. The bat according to claim 22 further comprising a knob removably attached to said handle end of said metal handle portion, and wherein said means for securing said second end of said locking pin to said handle end secures to said knob.

35. The bat according to claim 22 wherein sad means for securing sad first end of said locking pin comprises a receiving, bore longitudinally centered in said locking portion of said wood barrel portion and a means for securing said first end of said locking pin in said receiving bore.

36. The bat according to claim 35, wherein said means for securing said first end of said locking pin in said receiving bore is a liquid filler injected into said receiving bore.

37. The bat according to claim 36, wherein said receiving bore is L-shaped.

38. The bat according to claim 36, wherein said receiving bore has it round chamber at a distal end.

39. The bat according to claim 35, wherein said means for securing said first end of said locking pin in said receiving bore comprises said first end of said locking pin being threaded and screwed into said receiving bore.

40. The bat according to claim 39, wherein said wood barrel portion is removably attached to said metal handle end.

41. The bat according to claim 34, wherein said means for securing said second end of said locking pin to said knob comprises a central bore through said knob wherein said second end of said locking pin is inserted through said central bore.

42. The bat according to claim 41, wherein said knob further comprises a recessed portion and a covering cap for insertion into said recessed portion such that said covering cap is removable.

43.The bat according to claim 42, wherein said second end of said locking pin is welded and said covering cap is permanently secured in said recessed portion of said knob.

44. The bat according to claim 22, further comprising a knob removably attached to said handle end of said metal handle portion, and wherein said locking pin is a screw having a head end, an engaging end, and a length.

45. A method for manufacturing a bat having a wood barrel portion and a metal handle portion, wherein the wood barrel portion has a hitting portion and a locking portion, and the metal handle portion has a barrel receiving end, a handle end, and a knob attached to the handle end, comprising the steps of:

a. cutting the wood barrel portion to have a hitting portion and a locking portion;

b. drilling a locking pin bore longitudinally centered in said locking portion of said wood barrel portion;

c. drilling a T-pin bore in said locking portion of said wood barrel portion, wherein said T-pin bore is traverse to said locking pin bore d. drilling an anchor bore though a first end of a locking pin wherein the length of said locking pin is about the length of the metal handle portion;

e. inserting said first end of said locking pin in said locking pin bore;

f. aligning said T-pin bore of said locking portion with said anchor bore of said locking pin;

g. inserting a T-pin through said T-pin bore and said anchor bore;

h. sliding said locking portion of said wood barrel portion into said barrel receiving end of said metal handle portion; and i. securing a second end of said locking pin to said knob.

46. The method according to claim 45, further comprising the step:

j. injecting a liquid filler into the locking pin bore after said step g.

47. The method according to claim 45, further comprising the step:

j. wrapping a cushioning sleeve around the locking portion of the wood barrel portion before said step h.

48. The method according to claim 45, further comprising the step:

j. insulating the locking pin in the metal handle portion before said step h.

49. A method for manufacturing a wood barrel portion of a bat wherein the bat comprises a wood barrel portion and a metal handle portion, comprising the steps of:

a. cutting the wood barrel portion to have a hitting portion and a locking portion wherein the locking portion tapers;

b. drilling a locking pin bore longitudinally centered in said locking portion of said wood barrel portion; and c. drilling a T-pin bore in said locking portion of said wood barrel portion, wherein said T-pin bore is traverse to said locking pin bore.

* * * * *